US008167595B2

(12) United States Patent
Duppert

(10) Patent No.: US 8,167,595 B2
(45) Date of Patent: May 1, 2012

(54) INLET SCREEN AND SCROLL COMPRESSOR INCORPORATING SAME

(75) Inventor: Ronald J. Duppert, Fayetteville, NY (US)

(73) Assignee: Bitzer Scroll Inc., Syracuse, NY (US)

( * ) Notice: Subject to any disclaimer, the term of this patent is extended or adjusted under 35 U.S.C. 154(b) by 803 days.

(21) Appl. No.: 12/250,696

(22) Filed: Oct. 14, 2008

(65) Prior Publication Data

US 2010/0092320 A1 Apr. 15, 2010

(51) Int. Cl.

| | |
|---|---|
| ***F01C 1/02*** | (2006.01) |
| ***F01C 1/063*** | (2006.01) |
| ***F04C 2/00*** | (2006.01) |
| ***F04C 2/02*** | (2006.01) |
| ***F04C 2/063*** | (2006.01) |
| ***B01D 29/00*** | (2006.01) |

(52) U.S. Cl. ..... 418/55.6; 418/46; 418/47; 418/55.1; 418/270; 418/DIG. 1; 210/348

(58) Field of Classification Search ..... 418/55.6, 418/55.1, 270, 46, 47, DIG. 1; 210/348
See application file for complete search history.

(56) References Cited

U.S. PATENT DOCUMENTS

| | | | | |
|---|---|---|---|---|
| 2,291,279 | A * | 7/1942 | Jaworowski | 418/46 |
| 4,655,696 | A | 4/1987 | Utter | |
| 4,696,630 | A | 9/1987 | Sakata et al. | |
| 4,927,339 | A | 5/1990 | Riffe et al. | |
| 5,090,878 | A | 2/1992 | Haller | |
| 5,320,506 | A | 6/1994 | Fogt | |
| 5,427,511 | A | 6/1995 | Caillat et al. | |
| 6,227,830 | B1 | 5/2001 | Fields et al. | |
| 6,315,536 | B1 * | 11/2001 | DeVore et al. | 418/55.6 |
| 6,398,530 | B1 | 6/2002 | Hasemann | |
| 6,439,867 | B1 | 8/2002 | Clendenin | |
| 6,488,489 | B2 | 12/2002 | Williams et al. | |
| 6,682,327 | B2 | 1/2004 | Milliff et al. | |
| 6,761,541 | B1 | 7/2004 | Clendenin | |
| 6,814,551 | B2 | 11/2004 | Kammhoff et al. | |
| 6,960,070 | B2 | 11/2005 | Kammhoff et al. | |
| 7,096,516 | B1 | 8/2006 | Moore, Jr. et al. | |
| 7,112,046 | B2 | 9/2006 | Kammhoff et al. | |
| 7,878,775 | B2 | 2/2011 | Duppert et al. | |
| 7,878,780 | B2 | 2/2011 | Bush et al. | |
| 7,918,658 | B2 | 4/2011 | Bush et al. | |
| 7,963,753 | B2 | 6/2011 | Bush | |
| 7,967,581 | B2 | 6/2011 | Beagle et al. | |
| 2003/0143095 | A1 | 7/2003 | Ono | |

(Continued)

FOREIGN PATENT DOCUMENTS

JP 2008-157174 A 7/2008

*Primary Examiner* — Mary A Davis
(74) *Attorney, Agent, or Firm* — Reinhart Boerner Van Deuren P.C.

(57) ABSTRACT

A suction screen member is provided that bridges the inlet port and entrance port between a compressor housing and a suction duct in a scroll compressor. The suction screen member also serves to screen fluid entering the scroll compressor to prevent particulates from entering the scroll compressor. The suction screen member may be formed from only two components, including a sheet metal body that has a folded over section to provide a mounting segment that mounts into the inlet fitting for the outer housing and a tubular extension. Crimping of the folded over segment can secure the screen thereto. Other embodiments may have employ welding for screen attachment.

23 Claims, 13 Drawing Sheets

U.S. PATENT DOCUMENTS

2007/0003424 A1* 1/2007 Benco et al. ..... 418/55.1
2007/0183916 A1* 8/2007 Kim et al. ..... 418/55.6
2009/0185921 A1 7/2009 Beagle et al.
2009/0185926 A1 7/2009 Bush
2009/0185927 A1 7/2009 Duppert et al.
2009/0185929 A1 7/2009 Duppert et al.
2009/0185932 A1 7/2009 Beagle et al.
2010/0092319 A1 4/2010 Duppert

* cited by examiner

INLET SCREEN AND SCROLL COMPRESSOR INCORPORATING SAME

FIELD OF THE INVENTION

The present invention relates to screens and/or scroll compressors for compressing refrigerant and more particularly relates to the suction screen members at the inlet of such scroll compressors.

BACKGROUND OF THE INVENTION

A scroll compressor is a certain type of compressor that is used to compress refrigerant for such applications as refrigeration, air conditioning, industrial cooling and freezer applications, and/or other applications where compressed fluid may be used. Such prior scroll compressors are known, for example, as exemplified in U.S. Pat. Nos. 6,398,530 to Hasemann; U.S. Pat. No. 6,814,551, to Kammhoff et al.; U.S. Pat. No. 6,960,070 to Kammhoff et al.; and U.S. Pat. No. 7,112,046 to Kammhoff et al., all of which are assigned to a Bitzer entity closely related to the present assignee. As the present disclosure pertains to improvements that can be implemented in these or other scroll compressor designs, the entire disclosures of U.S. Pat. Nos. 6,398,530; 7,112,046; 6,814,551; and 6,960,070 are hereby incorporated by reference in their entireties.

As is exemplified by these patents, scroll compressors conventionally include an outer housing having a scroll compressor contained therein. A scroll compressor includes first and second scroll compressor members. A first compressor member is typically arranged stationary and fixed in the outer housing. A second scroll compressor member is moveable relative to the first scroll compressor member in order to compress refrigerant between respective scroll ribs which rise above the respective bases and engage in one another. Conventionally the moveable scroll compressor member is driven about an orbital path about a central axis for the purposes of compressing refrigerant. An appropriate drive unit, typically an electric motor, is provided usually within the same housing to drive the movable scroll member.

The present invention pertains to improvements in the state of the art.

BRIEF SUMMARY OF THE INVENTION

The present invention is directed toward a suction screen member and/or a scroll compressor incorporating such a suction screen member, that may be used to bridge the distance between an inlet fitting and an internal suction duct within a scroll compressor housing, while at the same time serving to screen out particulates from entering the scroll bodies of the scroll compressor.

One aspect of the present invention is directed toward a scroll compressor that comprises a housing having an inlet opening and an outlet port in which an inlet fitting is mounted into the inlet opening thereby providing an inlet port. Scroll compressor bodies in the housing have respective bases and respective scroll ribs that project from the respective bases and in which mutually engage. The scroll compressor bodies are thereby operative to compress fluid entering from the inlet port and discharge the compressed fluid toward the outlet port. A motor provides rotational output operatively driving one of the scroll compressor bodies to facilitate relative movement therebetween for the compression of fluid. A suction duct in the housing has an entrance opening. A suction screen member has a mounting flange mounting the suction screen member in the inlet fitting and a tubular extension that bridges the inlet port of the housing and the entrance port of the suction duct within the housing. The suction screen member also incorporates a screen arranged to screen fluid flow flowing through the suction screen member, which may serve to screen out particulates (e.g. such as metal shavings or other undesirable particles in the refrigerant flow) that may result when connected to a refrigeration circuit.

Another aspect of the present invention is directed toward a suction screen member that comprises a ring body (including a mounting flange and a tubular extension) and a screen. The mounting flange in the tubular extension can be unitarily formed from sheet steel. The mounting flange may comprise a folded over metal section of the sheet steel that comprises inner and outer generally cylindrical rings joined at a bend forming an upstream end of the suction screen member. This makes the mounting flange at least two layers thick of sheet metal (as measured at at least one location, but not necessarily all locations). Alternatively, the sheet metal may not be folded over but a single layer thick. In either embodiment, an annular neck connects the mounting flange and the tubular extension and provides a necking down of the diameter and thereby the perimeter defined from the mounting flange to the tubular extension which can serve as a seating surface. The tubular section may be a single layer thick of sheet steel and the screen is arranged to screen fluid flow extending through the tubular extension.

According to one embodiment, the screen material itself may have a flat end disc portion and a cylindrical liner portion bonded (e.g. preferably welded) along the inside of the ring body, that is to at least one of the tubular extension, neck and/or mounting flange. This embodiment may also employ a smaller sided border frame at the downstream end of the suction screen member.

A feature, according to the above aspect and some embodiments, may be that the screen comprises a dome-shaped screen structure that projects away from a terminating end of the tubular extension opposite the upstream end. According to some embodiments, this screen may include a generally cylindrical liner segment that lines the tubular extension and is crimped within the folded over metal section of the mounting flange.

A further feature may be that axially extending slots may be formed partially into the tubular extension allowing for some flexibility and contraction and expansion of the terminating end portion of the tubular extension. Alternatively or additionally, a chamfer may be formed on a terminating end of the extension and the tubular extension may be solid as opposed to slotted, but sufficiently thin to provide for flexibility for accommodating this alignment. Specifically, one or more of the above structures provide means for accommodating misalignment between the inlet fitting and the entrance port of the internal suction duct contained in a scroll compressor housing when void during assembly of such a scroll compressor.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

Figure 1:
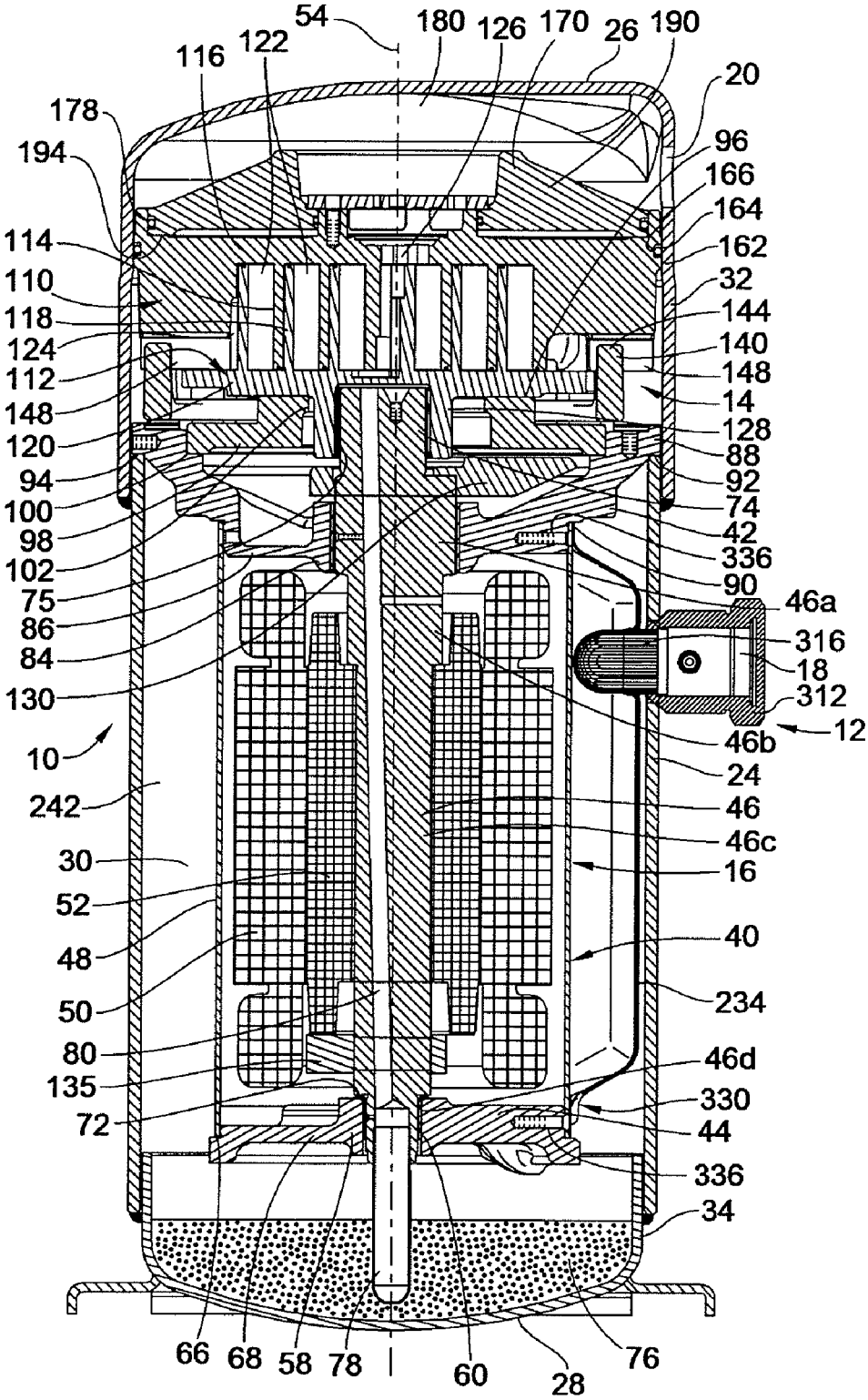
FIG. 1 is a cross section of a scroll compressor assembly in accordance with an embodiment of the present invention.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

An embodiment of the present invention is illustrated in the figures as a scroll compressor assembly 10 generally including an outer housing 12 in which a scroll compressor 14 can be driven by a drive unit 16. The scroll compressor assembly may be arranged in a refrigerant circuit for refrigeration, industrial cooling, freezing, air conditioning or other appropriate applications where compressed fluid is desired. Appropriate connection ports provide for connection to a refrigeration circuit and include a refrigerant inlet port 18 and a refrigerant outlet port 20 extending through the outer housing 12. The scroll compressor assembly 10 is operable through operation of the drive unit 16 to operate the scroll compressor 14 and thereby compress an appropriate refrigerant or other fluid that enters the refrigerant inlet port 18 and exits the refrigerant outlet port 20 in a compressed high pressure state.

The outer housing 12 may take many forms. In the preferred embodiment, the outer housing includes multiple shell sections and preferably three shell sections to include a central cylindrical housing section 24, a top end housing section 26 and a bottom end housing section 28. Preferably, the housing sections 24, 26, 28 are formed of appropriate sheet steel and welded together to make a permanent outer housing 12 enclosure. However, if disassembly of the housing is desired, other housing provisions can be made that can include metal castings or machined components.

The central housing section 24 is preferably cylindrical and telescopically interfits with the top and bottom end housing sections 26, 28. This forms an enclosed chamber 30 for housing the scroll compressor 14 and drive unit 16. Each of the top and bottom end housing sections 26, 28 are generally dome shaped and include respective cylindrical side wall regions 32, 34 to mate with the center section 24 and provide for closing off the top and bottom ends of the outer housing 12. As can be seen in FIG. 1, the top side wall region 32 telescopically overlaps the central housing section 24 and is exteriorly welded along a circular welded region to the top end of the central housing section 24. Similarly the bottom side wall region 34 of the bottom end housing section 28 telescopically interfits with the central housing section 24 (but is shown as being installed into the interior rather than the exterior of the central housing section 24) and is exteriorly welded by a circular weld region.

The drive unit 16 may preferably take the form of an electrical motor assembly 40, which is supported by upper and lower bearing members 42, 44. The motor assembly 40 operably rotates and drives a shaft 46. The electrical motor assembly 40 generally includes an outer annular motor housing 48, a stator 50 comprising electrical coils and a rotor 52 that is coupled to the drive shaft 46 for rotation together. Energizing the stator 50 is operative to rotatably drive the rotor 52 and thereby rotate the drive shaft 46 about a central axis 54.

Figure 4:
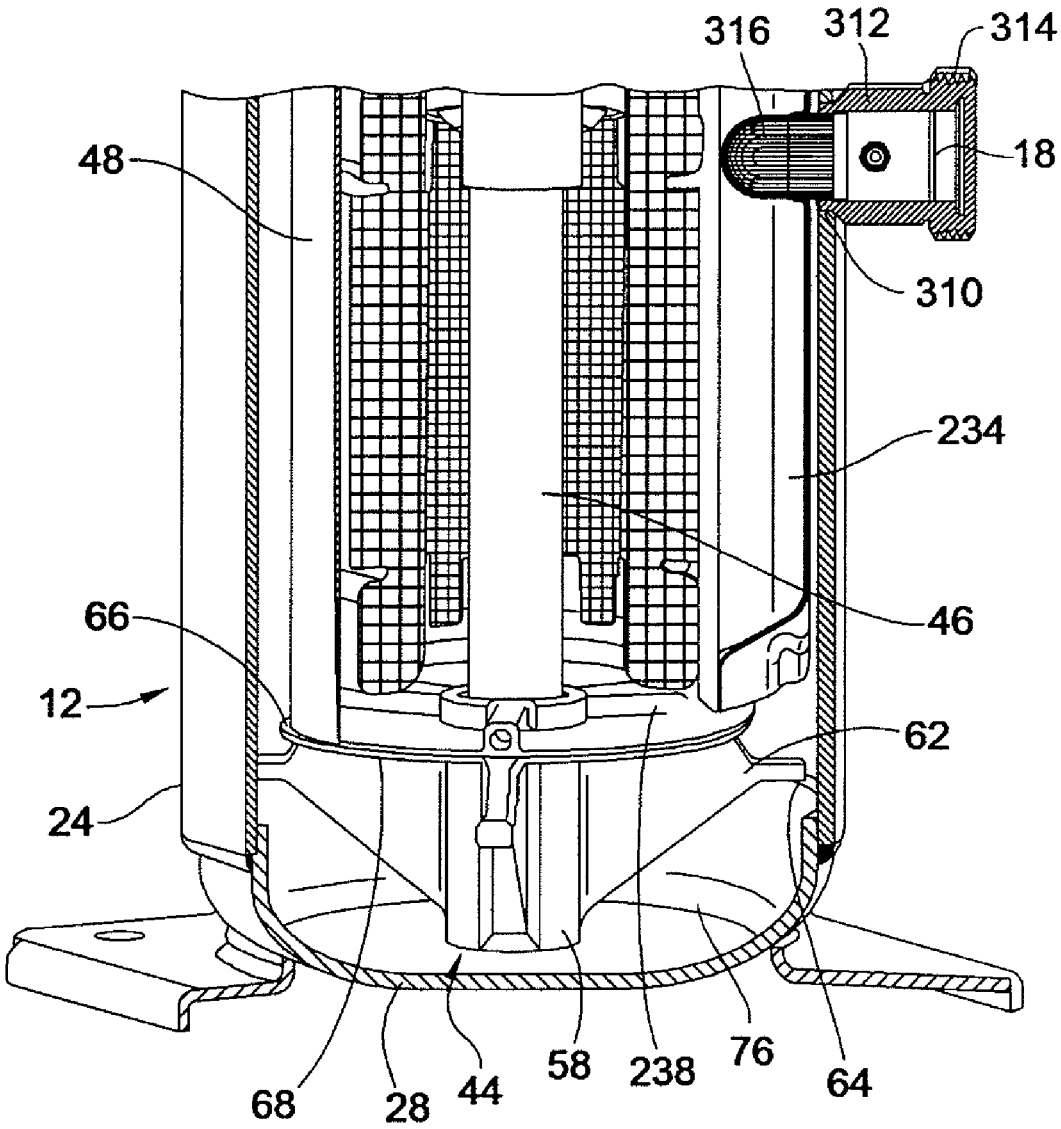
FIG. 4 is a partial cross section and cut-away view of a lower portion of the embodiment of FIG. 1.
Figure 5:
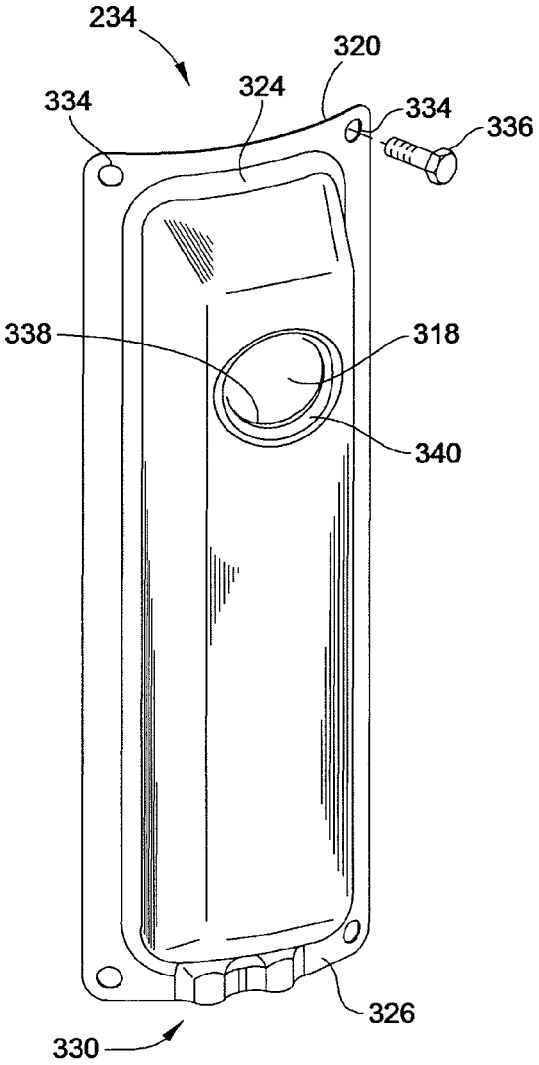
FIGS. 5 and 6 are isometric views of different sides of the suction duct employed in the scroll compressor assembly of the previous figures.
Figure 6:
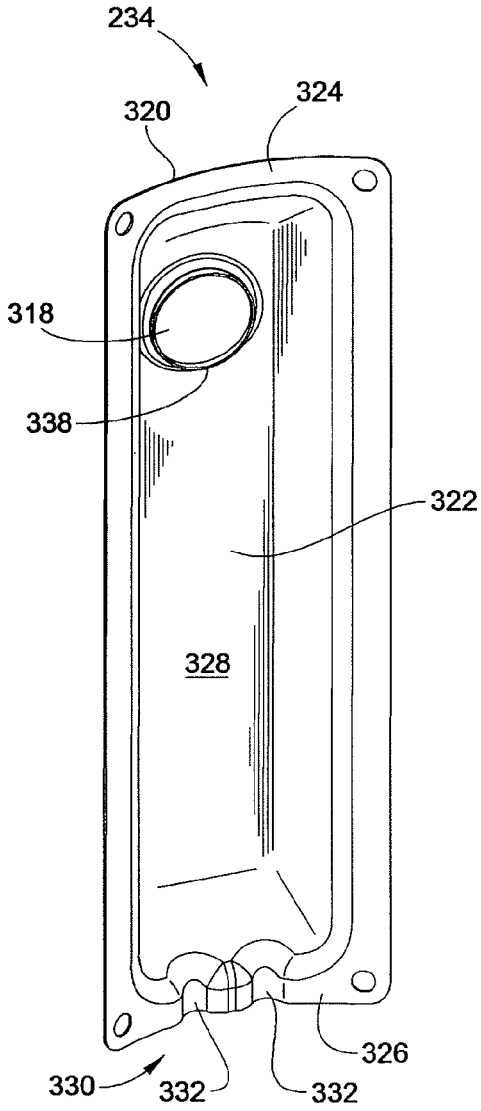
Figure 7:
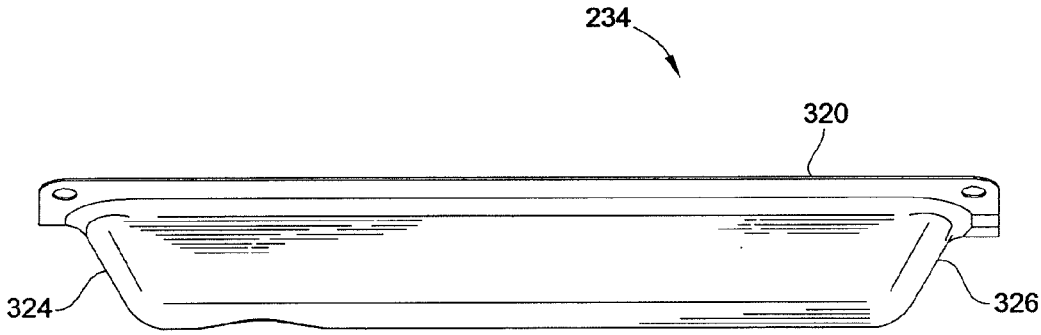
FIG. 7 is a side elevation view of the suction ducts shown in FIGS. 5 and 6.
Figure 8:
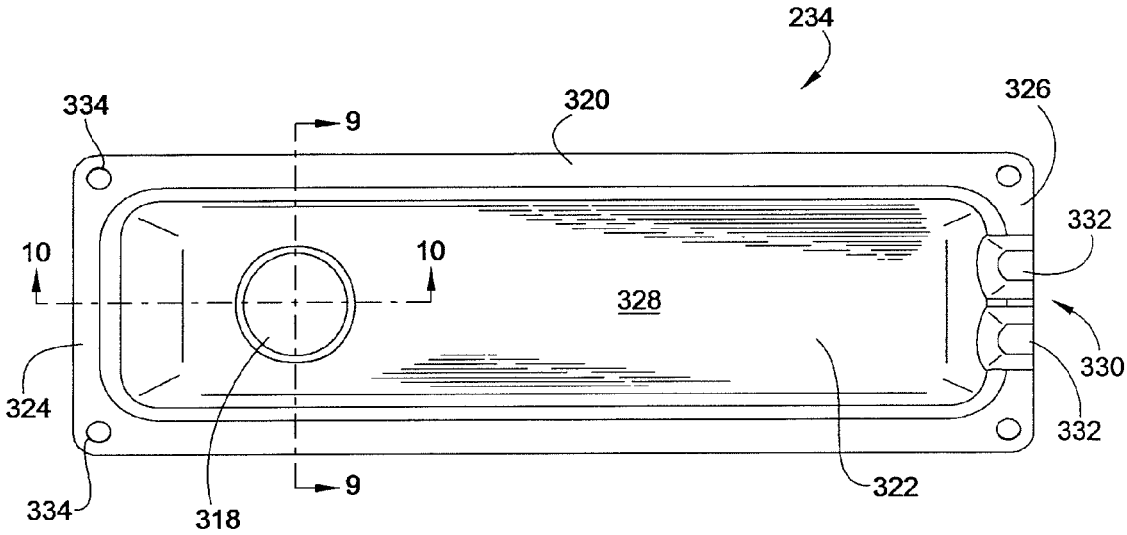
FIG. 8 is a plan view of the suction duct shown in FIG. 7.
Figure 9:
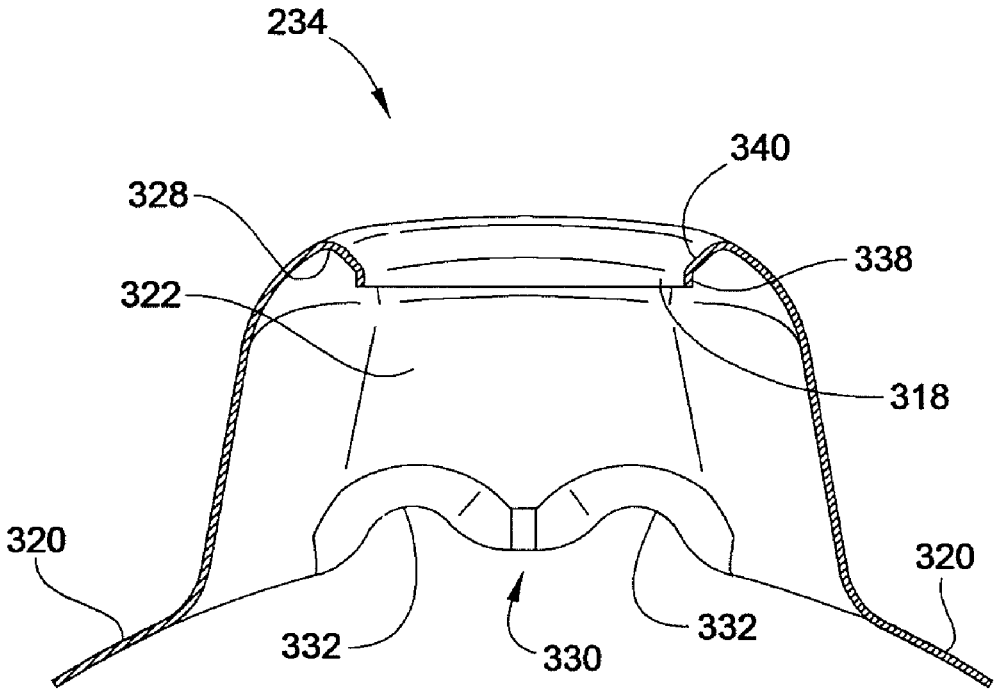
FIGS. 9 and 10 are cross sections of the suction duct taken about lines 9-9 and 10-10, respectively in FIG. 8.
Figure 10:
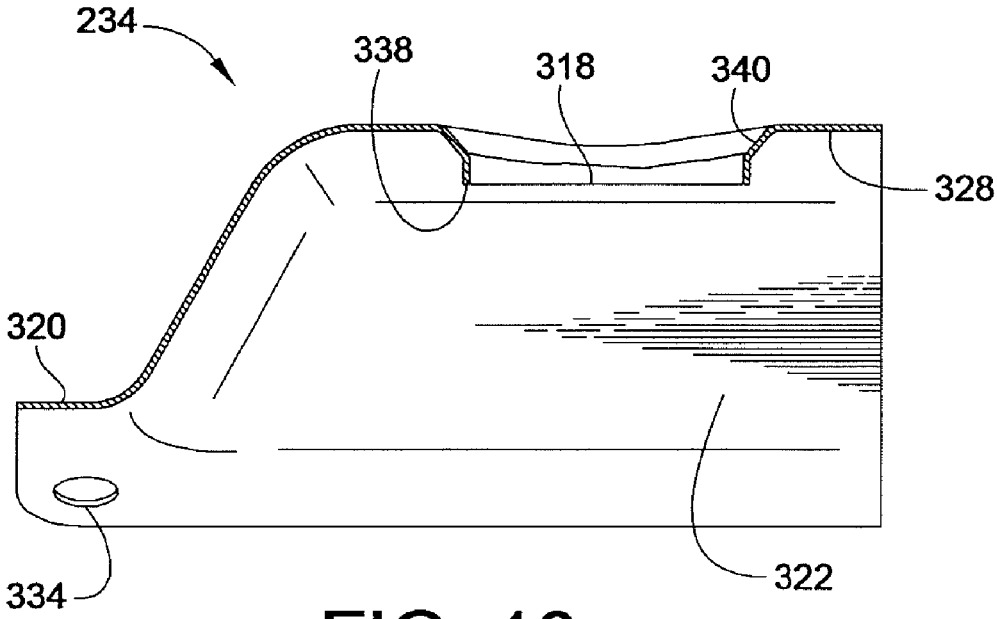

With reference to FIGS. 1 and 4, the lower bearing member 44 includes a central generally cylindrical hub 58 that includes a central bushing and opening to provide a cylindrical bearing 60 to which the drive shaft 46 is journaled for rotational support. A plurality of arms 62 and typically at least three arms project radially outward from the bearing central hub 58 preferably at equally spaced angular intervals. These support arms 62 engage and are seated on a circular seating surface 64 provided by the terminating circular edge of the bottom side wall region 34 of the bottom outer housing section 28. As such, the bottom housing section 28 can serve to locate, support and seat the lower bearing member 44 and thereby serves as a base upon which the internal components of the scroll compressor assembly can be supported.

The lower bearing member 44 in turn supports the cylindrical motor housing 48 by virtue of a circular seat 66 formed on a plate-like ledge region 68 of the lower bearing member 44 that projects outward along the top of the central hub 58. The support arms 62 also preferably are closely toleranced relative to the inner diameter of the central housing section. The arms 62 may engage with the inner diameter surface of the central housing section 24 to centrally locate the lower bearing member 44 and thereby maintain position of the central axis 54. This can be by way of an interference and press-fit support arrangement between the lower bearing member 44 and the outer housing 12 (See e.g. FIG. 4). Alternatively according to a more preferred configuration, as shown in FIG. 1, the lower bearing engages with the lower housing section 28 which is in turn attached to center section 24. Likewise, the outer motor housing 48 may be supported with an interference and press-fit along the stepped seat 66 of the lower bearing member 44. As shown, screws may be used to securely fasten the motor housing to the lower bearing member 44.

The drive shaft 46 is formed with a plurality of progressively smaller diameter sections 46*a*-46*d* which are aligned concentric with the central axis 54. The smallest diameter section 46*d* is journaled for rotation within the lower bearing member 44 with the next smallest section 46*c* providing a step 72 for axial support of the drive shaft 46 upon the lower bearing member 44. The largest section 46*a* is journaled for rotation within the upper bearing member 42.

The drive shaft 46 further includes an offset eccentric drive section 74 that has a cylindrical drive surface 75 about an offset axis that is offset relative to the central axis 54. This offset drive section 74 is journaled within a cavity of the movable scroll member of the scroll compressor 14 to drive the movable member of the scroll compressor about an orbital path when the drive shaft 46 is spun about the central axis 54. To provide for lubrication of all of these bearing surfaces, the outer housing 12 provides an oil lubricant sump 76 at the bottom end in which suitable oil lubricant is provided. The drive shaft 46 has an oil lubricant pipe and impeller 78 that acts as an oil pump when the drive shaft is spun and thereby pumps oil out of the lubricant sump 76 into an internal lubricant passageway 80 defined within the drive shaft 46. During rotation of the drive shaft 46, centrifugal force acts to drive lubricant oil up through the lubricant passageway 80 against the action of gravity. The lubricant passageway 80 includes various radial passages as shown to feed oil through centrifugal force to appropriate bearing surfaces and thereby lubricate sliding surfaces as may be desired.

The upper bearing member 42 includes a central bearing hub 84 into which the largest section 46*a* of the drive shaft 46 is journaled for rotation. Extending outward from the bearing hub 84 is a support web 86 that merges into an outer peripheral support rim 88. Provided along the support web 86 is an annular stepped seating surface 90 which may have an interference and press-fit with the top end of the cylindrical motor housing 48 to thereby provide for axial and radial location. The motor housing 48 may also be fastened with screws to the upper bearing member 42. The outer peripheral support rim 88 also may include an outer annular stepped seating surface 92 which may have an interference and press-fit with the outer housing 12. For example, the outer peripheral rim 88 can engage the seating surface 92 axially, that is it engages on a lateral plane perpendicular to axis 54 and not through a diameter. To provide for centering there is provided a diametric fit just below the surface 92 between the central housing section 24 and the support rim 88. Specifically, between the telescoped central and top-end housing sections 24, 26 is defined in internal circular step 94, which is located axially and radially with the outer annular step 92 of the upper bearing member 42.

The upper bearing member 42 also provides axial thrust support to the movable scroll member through a bearing support via an axial thrust surface 96. While this may be integrally provided by a single unitary component, it is shown as being provided by a separate collar member 98 that is interfit with the upper portion of the upper bearing member 42 along stepped annular interface 100. The collar member 98 defines a central opening 102 that is a size large enough to provide for receipt of the eccentric offset drive section 74 and allow for orbital eccentric movement thereof that is provided within a receiving portion of the movable scroll compressor member 112.

Turning in greater detail to the scroll compressor 14, the scroll compressor body is provided by first and second scroll compressor bodies which preferably include a stationary fixed scroll compressor body 110 and a movable scroll compressor body 112. The moveable scroll compressor body 112 is arranged for orbital movement relative to the fixed scroll compressor body 110 for the purpose of compressing refrigerant. The fixed scroll compressor body includes a first rib 114 projecting axially from a plate-like base 116 and is designed in the form of a spiral. Similarly, the second movable scroll compressor body 112 includes a second scroll rib 118 projecting axially from a plate-like base 120 and is in the design form of a similar spiral. The scroll ribs 114, 118 engage in one another and abut sealingly on the respective base surfaces 120, 116 of the respectively other compressor body 112, 110. As a result, multiple compression chambers 122 are formed between the scroll ribs 114, 118 and the bases 120, 116 of the compressor bodies 112, 110. Within the chambers 122, progressive compression of refrigerant takes place. Refrigerant flows with an initial low pressure via an intake area 124 surrounding the scroll ribs 114, 118 in the outer radial region (see e.g. FIGS. 2-3). Following the progressive compression in the chambers 122 (as the chambers progressively are defined radially inward), the refrigerant exits via a compression outlet 126 which is defined centrally within the base 116 of the fixed scroll compressor body 110. Refrigerant that has been compressed to a high pressure can exit the chambers 122 via the compression outlet 126 during operation of the scroll compressor.

The movable scroll compressor body 112 engages the eccentric offset drive section 74 of the drive shaft 46. More specifically, the receiving portion of the movable scroll compressor body 112 includes a cylindrical bushing drive hub 128 which slideably receives the eccentric offset drive section 74 with a slideable bearing surface provided therein. In detail, the eccentric offset drive section 74 engages the cylindrical drive hub 128 in order to move the moveable scroll compressor body 112 about an orbital path about the central axis 54 during rotation of the drive shaft 46 about the central axis 54. Considering that this offset relationship causes a weight imbalance relative to the central axis 54, the assembly preferably includes a counter weight 130 that is mounted at a fixed angular orientation to the drive shaft 46. The counter weight 130 acts to offset the weight imbalance caused by the eccentric offset drive section 74 and the movable scroll compressor body 112 that is driven about an orbital path (e.g. among other things, the scroll rib is not equally balanced). The counter weight 130 includes an attachment collar 132 and an offset weight region 134 (see counter weight shown best in FIG. 2) that provides for the counter weight effect and thereby balancing of the overall weight of the rotating components about the central axis 54 in cooperation with a lower counterweight 135 for balancing purposes. This provides for reduced vibration and noise of the overall assembly by internally balancing or cancelling out inertial forces.

Figure 2:
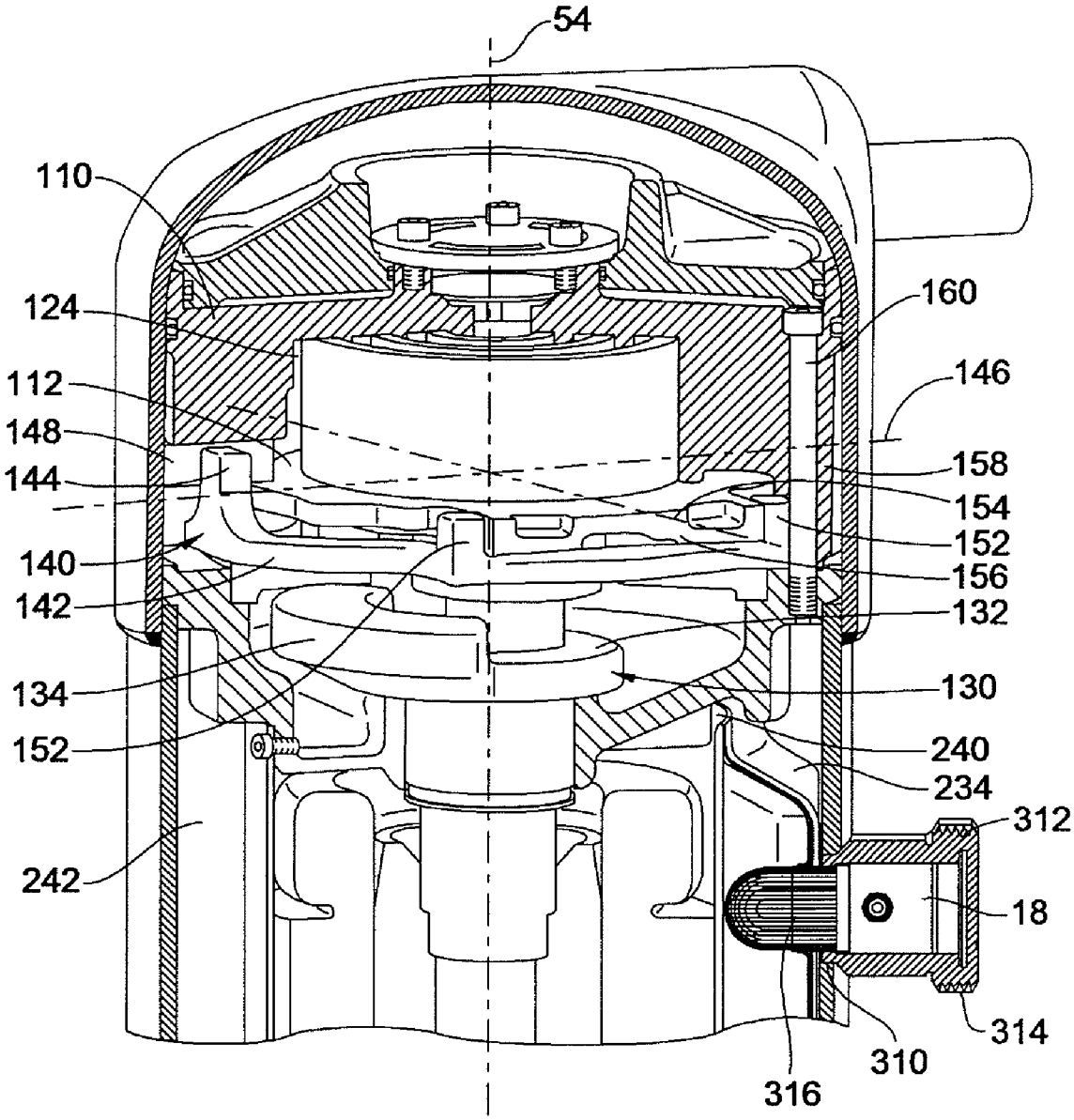
FIG. 2 is a partial cross section and cut-away view of an isometric drawing of an upper portion of the scroll compressor embodiment shown in FIG. 1.
Figure 3:
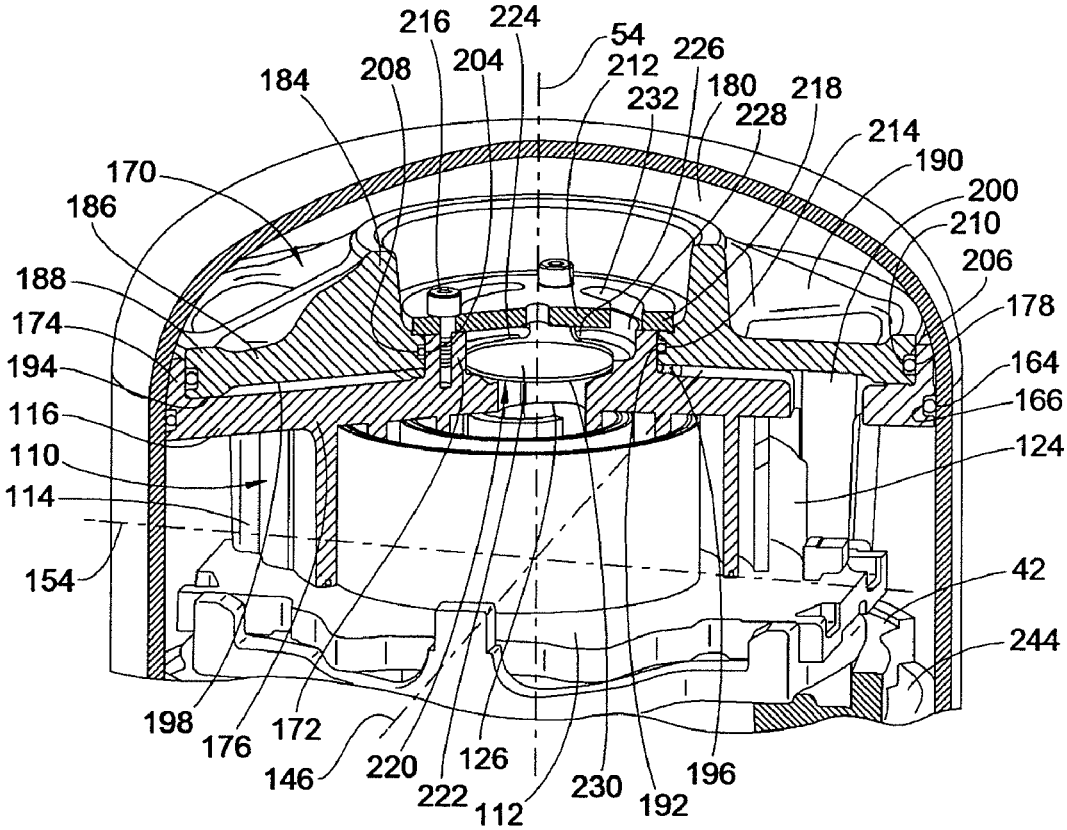
FIG. 3 is a similar view to FIG. 2 but enlarged and taken about a different angle and section in order to show other structural features.

With reference to FIGS. 1-3, and particularly FIG. 2, the guiding movement of the scroll compressor can be seen. To guide the orbital movement of the movable scroll compressor body 112 relative to the fixed scroll compressor body 110, an appropriate key coupling 140 may be provided. Keyed couplings are often referred to in the scroll compressor art as an "Oldham Coupling." In this embodiment, the key coupling 140 includes an outer ring body 142 and includes two first keys 144 that are linearly spaced along a first lateral axis 146 and that slide closely and linearly within two respective keyway tracks 148 that are linearly spaced and aligned along the first axis 146 as well. The key way tracks 148 are defined by the stationary fixed scroll compressor body 110 such that the linear movement of the key coupling 140 along the first lateral axis 146 is a linear movement relative to the outer housing 12 and perpendicular to the central axis 54. The keys can comprise slots, grooves or, as shown, projections which project from the ring body 142 of the key coupling 140. This control of movement over the first lateral axis 146 guides part of the overall orbital path of the moveable scroll compressor body 112.

Additionally, the key coupling includes four second keys 152 in which opposed pairs of the second keys 152 are linearly aligned substantially parallel relative to a second traverse lateral axis 154 that is perpendicular to the first lateral axis 146. There are two sets of the second keys 152 that act cooperatively to receive projecting sliding guide portions 156 that project from the base 120 on opposite sides of the movable scroll compressor body 112. The guide portions 156 linearly engage and are guided for linear movement along the second traverse lateral axis by virtue of sliding linear guiding movement of the guide portions 156 along sets of the second keys 152.

By virtue of the key coupling 140, the moveable scroll compressor body 112 has movement restrained relative to the fixed scroll compressor body 110 along the first lateral axis 146 and second traverse lateral axis 154. This results in the prevention of any relative rotation of the moveable scroll body as it allows only translational motion. More particularly, the fixed scroll compressor body 110 limits motion of the key coupling 140 to linear movement along the first lateral axis 146; and in turn, the key coupling 140 when moving along the first lateral axis 146 carries the moveable scroll 112 along the first lateral axis 146 therewith. Additionally, the movable scroll compressor body can independently move relative to the key coupling 140 along the second traverse lateral axis 154 by virtue of relative sliding movement afforded by the guide portions 156 which are received and slide between the second keys 152. By allowing for simultaneous movement in two mutually perpendicular axes 146, 154, the eccentric motion that is afforded by the eccentric offset drive section 74 of the drive shaft 46 upon the cylindrical drive hub 128 of the movable scroll compressor body 112 is translated into an orbital path movement of the movable scroll compressor body 112 relative to the fixed scroll compressor body 110.

Referring in greater detail to the fixed scroll compressor body 110, this body 110 is fixed to the upper bearing member 42 by an extension extending axially and vertically therebetween and around the outside of the moveable scroll compressor body 112. In the illustrated embodiment, the fixed scroll compressor body 110 includes a plurality of axially projecting legs 158 (see FIG. 2) projecting on the same side as the scroll rib from the base 116. These legs 158 engage and are seated against the top side of the upper bearing member 42. Preferably, bolts 160 (FIG. 2) are provided to fasten the fixed scroll compressor body 110 to the upper bearing member 42. The bolts 160 extend axially through the legs 158 of the fixed scroll compressor body and are fastened and screwed into corresponding threaded openings in the upper bearing member 42. For further support and fixation of the fixed scroll compressor body 110, the outer periphery of the fixed scroll compressor body includes a cylindrical surface 162 that is closely received against the inner cylindrical surface of the outer housing 10 and more particularly the top end housing section 26. A clearance gap between surface 162 and side wall 32 serves to permit assembly of upper housing 26 over the compressor assembly and subsequently to contain the o-ring seal 164. An O-ring seal 164 seals the region between the cylindrical locating surface 162 and the outer housing 112 to prevent a leak path from compressed high pressure fluid to the un-compressed section/sump region inside of the outer housing 12. The seal 164 can be retained in a radially outward facing annular groove 166.

With reference to FIGS. 1-3 and particularly FIG. 3, the upper side (e.g. the side opposite the scroll rib) of the fixed scroll 110 supports a floatable baffle member 170. To accommodate the same, the upper side of the fixed scroll compressor body 110 includes an annular and more specifically cylindrical inner hub region 172 and an outwardly spaced peripheral rim 174 which are connected by radially extending disc region 176 of the base 116. Between the hub 172 and the rim 174 is provided an annular piston-like chamber 178 into which the baffle member 170 is received. With this arrangement, the combination of the baffle member 170 and the fixed scroll compressor body 110 serve to separate a high pressure chamber 180 from lower pressure regions within the housing 10. While the baffle member 170 is shown as engaging and constrained radially within the outer peripheral rim 174 of the fixed scroll compressor body 110, the baffle member 170 could alternatively be cylindrically located against the inner surface of the outer housing 12 directly.

As shown in the embodiment, and with particular reference to FIG. 3, the baffle member 170 includes an inner hub region 184, a disc region 186 and an outer peripheral rim region 188. To provide strengthening, a plurality of radially extending ribs 190 extending along the top side of the disc region 186 between the hub region 184 and the peripheral rim region 188 may be integrally provided and are preferably equally angularly spaced relative to the central axis 54. The baffle member 170 in addition to tending to separate the high pressure chamber 180 from the remainder of the outer housing 12 also serves to transfer pressure loads generated by high pressure chamber 180 away from the inner region of the fixed scroll compressor body 110 and toward the outer peripheral region of the fixed scroll compressor body 110. At the outer peripheral region, pressure loads can be transferred to and carried more directly by the outer housing 12 and therefore avoid or at least minimize stressing components and substantially avoid deformation or deflection in working components such as the scroll bodies. Preferably, the baffle member 170 is floatable relative to the fixed scroll compressor body 110 along the inner peripheral region. This can be accomplished, for example, as shown in the illustrated embodiment by a sliding cylindrical interface 192 between mutually cylindrical sliding surfaces of the fixed scroll compressor body and the baffle member along the respective hub regions thereof. As compressed high pressure refrigerant in the high pressure chamber 180 acts upon the baffle member 170, substantially no load may be transferred along the inner region, other than as may be due to frictional engagement. Instead, an axial contact interface ring 194 is provided at the radial outer periphery where the respective rim regions are located for the fixed scroll compressor body 110 and the baffle member 170. Preferably, an annular axial gap 196 is provided between the innermost diameter of the baffle member 170 and the upper side of the fixed scroll compressor body 110. The annular axial gap 196 is defined between the radially innermost portion of the baffle member and the scroll member and is adapted to decrease in size in response to a pressure load caused by high pressure refrigerant compressed within the high pressure chamber 180. The gap 196 is allowed to expand to its relaxed size upon relief of the pressure and load.

To facilitate load transfer most effectively, an annular intermediate or lower pressure chamber 198 is defined between the baffle member 170 and the fixed scroll compressor body 110. This intermediate or lower pressure chamber can be subject to either the lower sump pressure as shown, or can be subject to an intermediate pressure (e.g. through a fluid communication passage 200 defined through the fixed scroll compressor body to connect one of the individual compression chambers 122 to the chamber 198). Load carrying characteristics can therefore be configured based on the lower or intermediate pressure that is selected for best stress/deflection management. In either event, the pressure contained in the intermediate or low pressure chamber 198 during operation is substantially less than the high pressure chamber 180 thereby causing a pressure differential and load to develop across the baffle member 170.

To prevent leakage and to better facilitate load transfer, inner and outer seals 204, 206 may be provided, both of which may be resilient, elastomeric O-ring seal members. The inner seal 204 is preferably a radial seal and disposed in a radially inwardly facing inner groove 208 defined along the inner diameter of the baffle member 170. Similarly the outer seal 206 can be disposed in a radially outwardly facing outer groove 210 defined along the outer diameter of the baffle member 170 in the peripheral rim region 188. While a radial seal is shown at the outer region, alternatively or in addition an axial seal may be provided along the axial contact interface ring 194.

While the baffle member 170 could be a stamped steel component, preferably and as illustrated, the baffle member 170 comprises a cast and/or machined member (and may be aluminum) to provide for the expanded ability to have several structural features as discussed above. By virtue of making the baffle member in this manner, heavy stamping of such baffles can be avoided.

Additionally, the baffle member 170 can be retained to the fixed scroll compressor body 110. Specifically, as can be seen in the figures, a radially inward projecting annular flange 214 of the inner hub region 184 of the baffle member 170 is trapped axially between the stop plate 212 and the fixed scroll compressor body 11O. The stop plate 212 is mounted with bolts 216 to a fixed scroll compressor body 210. The stop plate 212 includes an outer ledge 218 that projects radially over the inner hub 172 of the fixed scroll compressor body 110. The stop plate ledge 218 serves as a stop and retainer for the baffle member 170. In this manner, the stop plate 212 serves to retain the baffle member 170 to the fixed scroll compressor body 110 such that the baffle member 170 is carried thereby.

As shown, the stop plate 212 can be part of a check valve 220. The check valve includes a moveable valve plate element 222 contained within a chamber defined in the outlet area of the fixed scroll compressor body within the inner hub 172. The stop plate 212 thus closes off a check valve chamber 224 in which the moveable valve plate element 222 is located. Within the check valve chamber there is provided a cylindrical guide wall surface 226 that guides the movement of the check valve 220 along the central axis 54. Recesses 228 are provided in the upper section of the guide wall 226 to allow for compressed refrigerant to pass through the check valve when the moveable valve plate element 222 is lifted off of the valve seat 230. Openings 232 are provided in the stop plate 212 to facilitate passage of compressed gas from the scroll compressor into the high pressure chamber 180. The check valve is operable to allow for one way directional flow such that when the scroll compressor is operating, compressed refrigerant is allowed to leave the scroll compressor bodies through the compression outlet 126 by virtue of the valve plate element 222 being driven off of its valve seat 230. However, once the drive unit shuts down and the scroll compressor is no longer operating, high pressure contained within the high pressure chamber 180 forces the movable valve plate element 222 back upon the valve seat 230. This closes off check valve 220 and thereby prevents backflow of compressed refrigerant back through the scroll compressor.

During operation, the scroll compressor assembly 10 is operable to receive low pressure refrigerant at the housing inlet port 18 and compress the refrigerant for delivery to the high pressure chamber 180 where it can be output through the housing outlet port 20. As is shown, in FIGS. 1 and 4, a suction duct 234 is connected internally of the housing 12 to guide the lower pressure refrigerant from the inlet port 18 into housing and beneath the motor housing. This allows the low pressure refrigerant to flow through and across the motor and thereby cool and carry heat away from the motor which can be caused by operation of the motor. Low pressure refrigerant can then pass longitudinally through the motor housing and around through void spaces therein toward the top end where it can exit through a plurality of motor housing outlets 240 (see FIG. 2) that are equally angularly spaced about the central axis 54. The motor housing outlets 240 may be defined either in the motor housing 48, the upper bearing member 42 or by a combination of the motor housing and upper bearing member (e.g. by gaps formed therebetween as shown in FIG. 2). Upon exiting the motor housing outlet 240, the low pressure refrigerant enters an annular chamber 242 formed between the motor housing and the outer housing. From there, the low pressure refrigerant can pass through the upper bearing member through a pair of opposed outer peripheral through ports 244 that are defined by recesses on opposed sides of the upper bearing member 42 to create gaps between the bearing member 42 and housing 12 as shown in FIG. 3 (or alternatively holes in bearing member 42). The through ports 244 may be angularly spaced relative to the motor housing outlets 240. Upon passing through the upper bearing member 42, the low pressure refrigerant finally enters the intake area 124 of the scroll compressor bodies 110, 112. From the intake area 124, the lower pressure refrigerant finally enters the scroll ribs 114, 118 on opposite sides (one intake on each side of the fixed scroll compressor body) and is progressively compressed through chambers 122 to where it reaches it maximum compressed state at the compression outlet 126 where it subsequently passes through the check valve 220 and into the high pressure chamber 180. From there, high pressure compressed refrigerant may then pass from the scroll compressor assembly 10 through the refrigerant housing outlet port 20.

Referring to FIGS. 1-4, it is seen that a suction duct 234 is preferably employed to direct incoming fluid flow (e.g. refrigerant) through the housing inlet 18. To provide for the inlet 18, the housing includes an inlet opening 310 in which an inlet fitting 312 is provided that includes a connector such as threads 314 or other such connection means such as a barb or quick connect coupler, for example. The inlet fitting 312 is welded to the housing shell in engagement with the inlet opening 3 10. The inlet opening 310 and the inlet fitting 312 are thereby provided for communicating the refrigerant into the housing.

Additionally, a suction screen member 316 is provided to form a common bridge and thereby communicate refrigerant from the inlet 18 through the entrance opening and port 318 formed in the suction duct 234. Substantially all (in other words—all or most) of the incoming refrigerant is thereby directed through the suction screen member where metal shavings or other particulates can be screened out by an integral screen provided by the suction screen member 316. Once passing through the screen, refrigerant is then directed by the suction duct 234 to a location upstream and at the entrance of the motor housing.

Turning in greater detail to the suction duct 234, and referring to FIGS. 5-10, it is seen that the suction duct comprises a stamped sheet steel metal body having a constant wall thickness with an outer generally rectangular and arcuate mounting flange 320 which surrounds a duct channel 322 that extends between a top end 324 and a bottom end 326. The entrance opening and port 318 is formed through a channel bottom 328 proximate the top end 324. This opening and port 318 provide means for communicating and receiving fluid from the inlet 18 via a suction screen flange 316 which is received through the outer compressor housing wall and into duct channel 322 of the suction duct 234. The duct channel provides a fluid flow path to a drain port 330 proximate the bottom end 326 as shown in the figures. In this embodiment, the drain port 330 extends through the bottom end 326 and thereby provides a port for draining lubricant oil into the lubricant sump (see e.g. 76 in FIG. 1) and also to communicate substantially all of the refrigerant for compression to a location just upstream of the motor housing. Preferably, the drain port 330 is provided by at least one and typically two or more recessed grooves 332 that connect the duct channel 322 toward the lubricant sump. The recessed grooves 332 are formed into the rectangular mounting flange 320 and extends substantially vertically and axially to provide for axial and/or vertical flow as opposed to circumferential or radial flow.

With reference to FIGS. 5-11, the mounting flange 320 is generally rectangular and arcuate about an axis to surround the duct channel 322 and abuts the exterior surface of the motor housing. It further comprises fasteners sockets in the form of holes 334 proximate the corners of the mounting flange 320 such that fasteners 336 may be used to fasten and thereby secure the mounting flange 320 to the motor housing. Preferably, the suction duct is a metal stamping of sheet metal to provide the body and wall structure of the suction duct 234 as a unitary member. The rectangular and arcuate mounting flange and the duct channel can readily be stamped into the sheet metal to provide an elongated duct channel 322 and bottom grooves 332 as well as the fastener holes 334. The entrance port 318 is also formed by stamping and punching out the generally circular disk from the sheet metal. Material stamp forming of the punched out area creates an annular opening flange 338 defining the entrance port 318, which projects from the channel bottom 328 toward the mounting flange 320. As shown, the annular opening flange 338 tapers as it extends radially inward and away from the channel bottom 328 so as to provide a tapered guide surface 340 that facilitates insertion and assembly of the suction screen flange 316 into engagement and received within the suction duct 234.

Not only does the suction duct 234 direct refrigerant and substantially all of the refrigerant from the inlet 18 to a location upstream of the motor and to direct fluid flow through the motor, but it also acts as a gravitational drain preferably by being at the absolute gravitational bottom of the suction duct or proximate thereto so as to drain lubricant received in the suction duct into the lubricant sump 76. This can be advantageous for several reasons. First, when it is desirable to fill the lubricant sump either at initial charting or otherwise, oil can readily be added through the inlet 18 which acts also as an oil fill port as oil will naturally drain through the suction duct and into the oil sump through the drain port 330. The housing can thereby be free of a separate oil port. Additionally, the surfaces of the suction duct 234 and redirection of oil therein causes coalescing of oil lubricant mist which can then collect within the duct channel and drain through the drain port 330 back into the oil sump. Thus, direction of refrigerant as well as direction of lubricant oil is achieved with the suction duct.

Turning in greater detail to the suction screen member 316 with additional reference to a first embodiment shown in FIGS. 11-15, the suction screen member 316 generally includes a solid ring body with several regions including a mounting flange 342 that is adapted to mount the overall structure in the inlet fitting 312; and a tubular and cylindrical extension 344. The tubular extension supports a screen 346 along its inside. As shown, the mounting flange 342 and the tubular extension 344 are commonly and unitarily formed from relatively thin sheet metal material that has a constant wall thickness. The mounting flange 342 comprises a folded over metal section that includes inner and outer cylindrical rings 348, 350 that are joined at an annular bend 352 that forms an upstream end of the suction screen member 316. This makes the mounting flange 342 at least two layers thick of sheet metal. Connecting the mounting flange 342 and the tubular extension 344 is an annular neck 354 that may be conical in shape and reduces the diameter and thereby the perimeter from the mounting flange 342 to the tubular extension 344. This also provides an annular seating surface 356 that axially abuts and seats against a corresponding annular seat 358 defined between larger and smaller diameter openings within the inlet fitting 312.

The tubular extension 344 may be generally cylindrical and of a smaller diameter then the mounting flange 342 and may only be a single layer thick of sheet metal material. The screen 346 is arranged to screen fluid flow through the tubular extension 344 and thereby prevent the incursion of metal shavings, or other particulates into the scroll compressor.

In this embodiment, the screen 346 comprises a dome-shaped screen structure such as mesh material that projects away from a terminating end of the tubular extension 344 and covers the entire opening of the tubular extension 344 at the exit end to ensure that all refrigerant or other fluid (such as lubricant) entering the compressor housing is free of undesirable particulates such as metal shavings. As such, the screen 346 generally includes a dome portion 360 and also includes a generally cylindrical liner segment that lines the inside diameter of the tubular extension 344 and extends over the neck region and is crimped within the folded over metal section between the inner and outer crimped rings 348, 350 of the mounting flange 342. This secures and adequately seals the mesh material of the screen 346 with the sheet metal body of the mounting flange and tubular extension structure. As a result, the suction screen member may consist of as little as only two component parts including the sheet metal body and the mesh acting as a screen.

Figure 11:
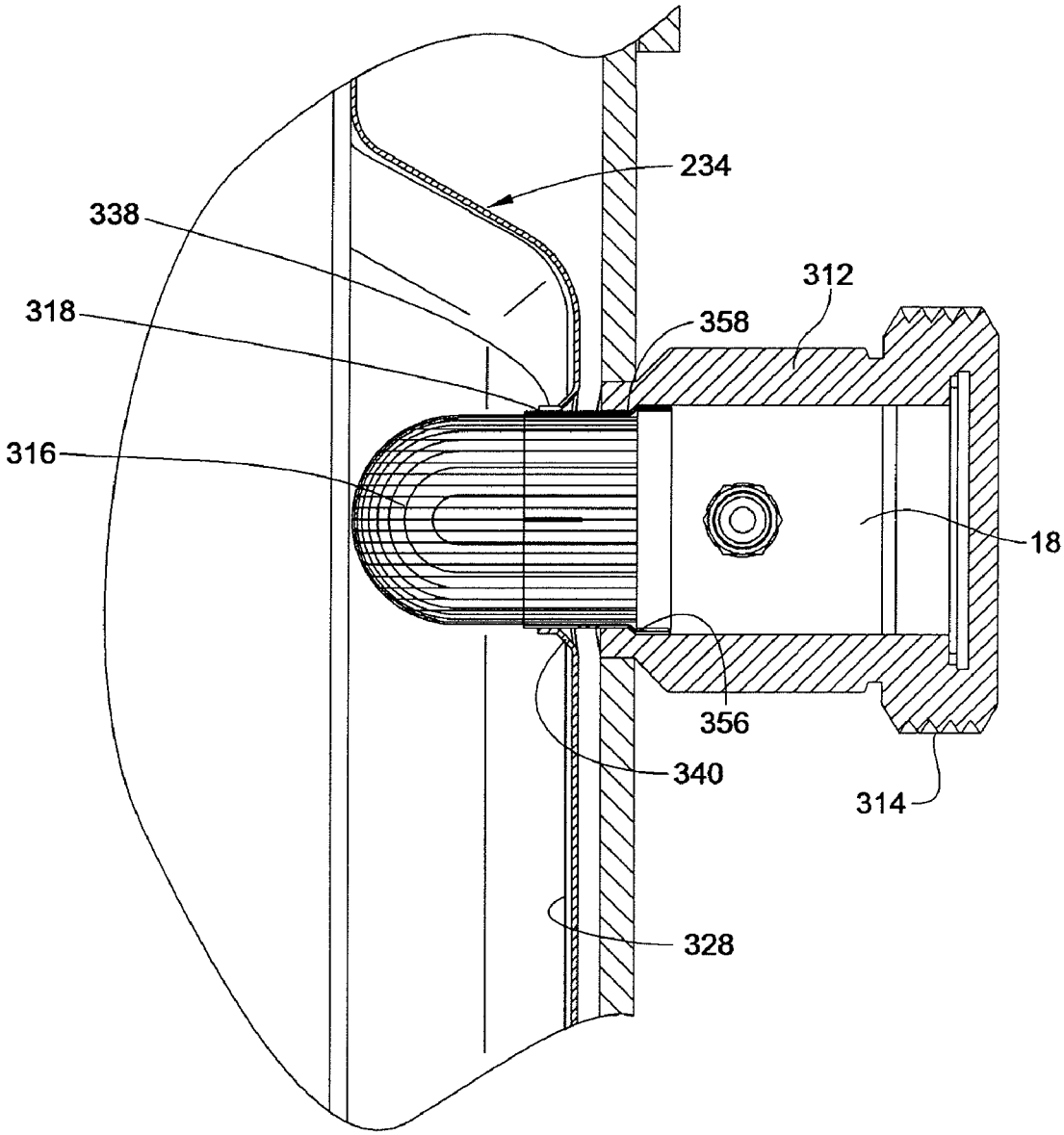
FIG. 11 is an enlarged cross sectional illustration of the region proximate the inlet fitting of the compressor housing illustrating the suction screen member according to one of the embodiments in greater detail and how it bridges between the inlet fitting and the suction duct.
Figure 12:
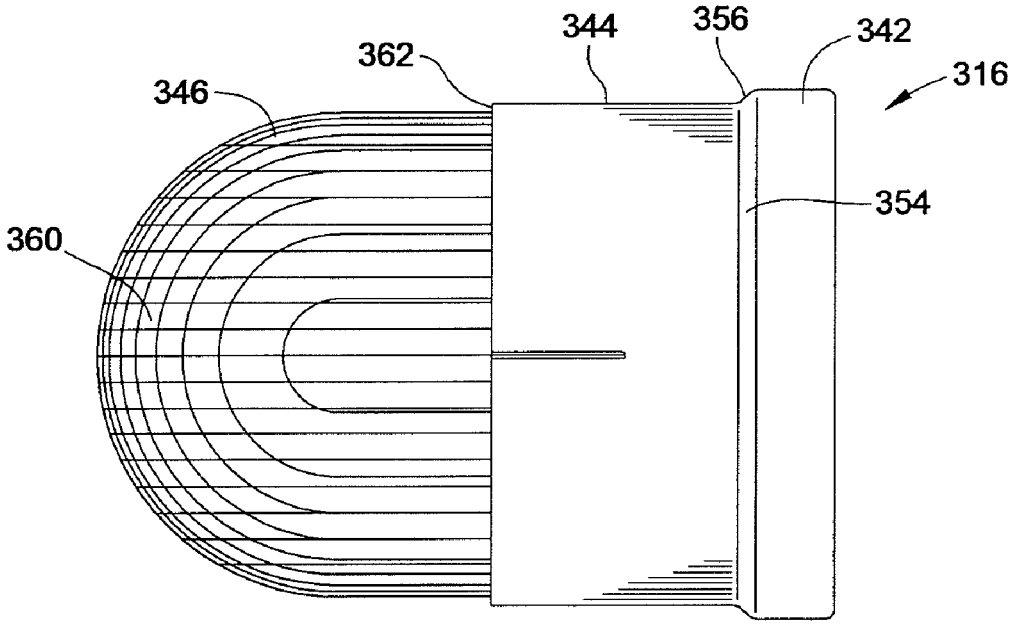
FIGS. 12 and 13 are side and end views of the suction screen member of one embodiment shown in the previous figures and particularly the previous enlarged figure.
Figure 13:
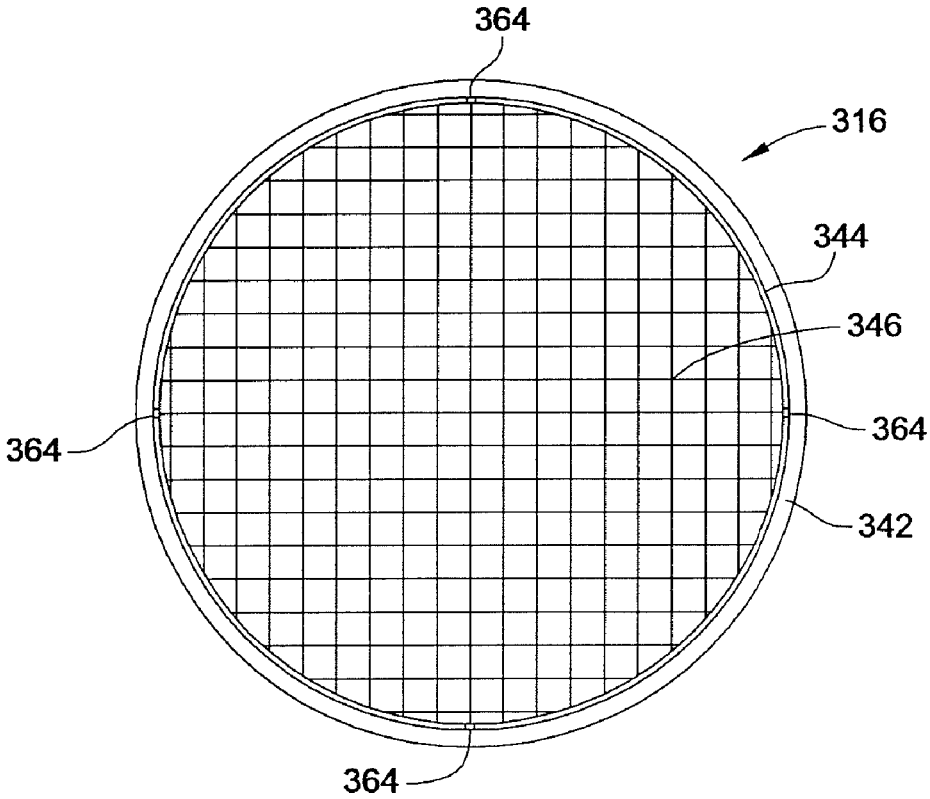
Figure 14:
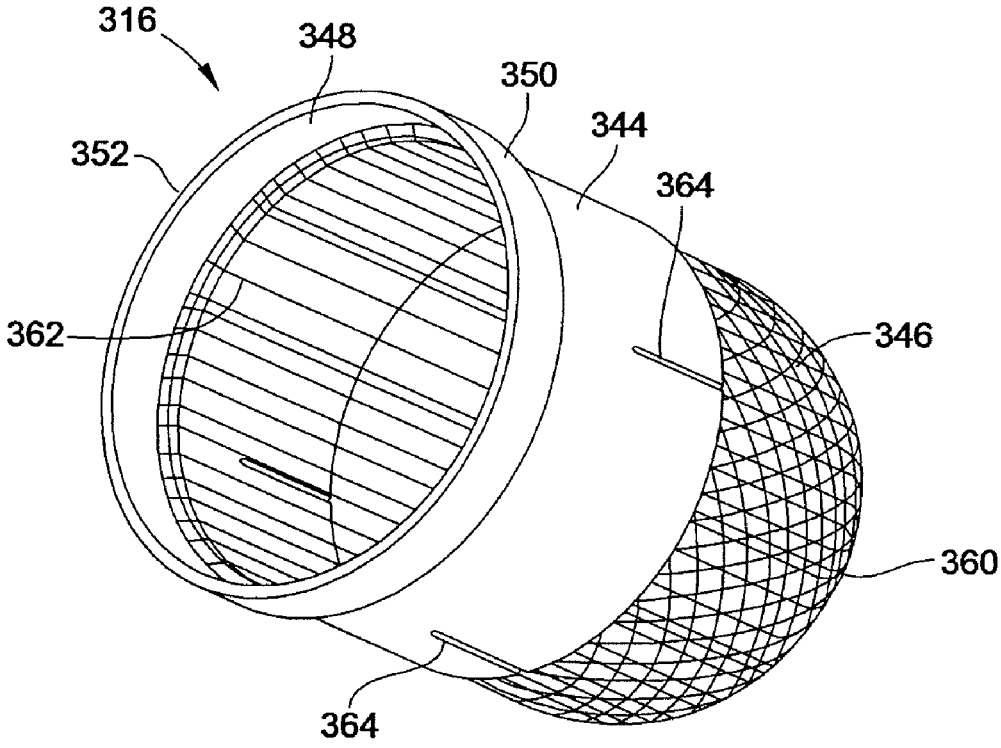
FIG. 14 is an isometric view of the suction screen member shown in FIGS. 11-13.
Figure 15:
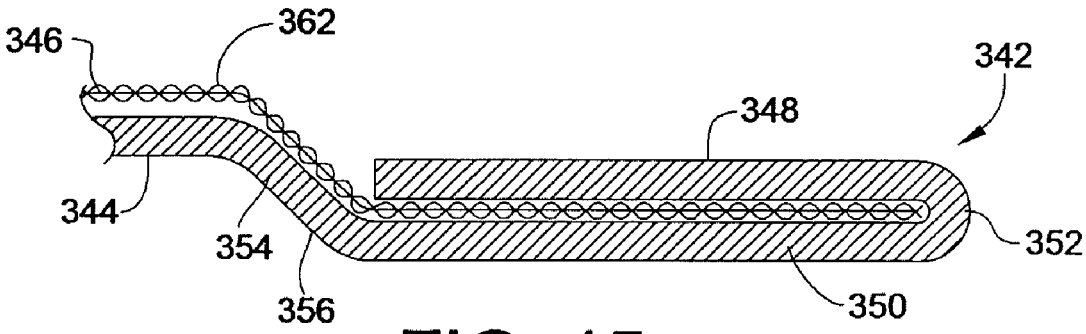
FIG. 15 is an enlarged cross sectional view of the crimped region of the suction screen member illustrating how the screen is crimped within the sheet metal structure of the mounting flange.

As shown in FIG. 11, the suction screen member 316 bridges the gap between the suction inlet fitting 312 and the internal suction duct 234. As shown, the entrance port 318 of the suction duct 234 is aligned with the inlet port 18 formed by the inlet fitting 312 for the compressor housing. Preferably these openings are diametrically and concentrically aligned. Additionally, it is noted that a single part both provides for screening of fluid flow and also bridging the gap to ensure that substantially all of the fluid flow into the compressor housing does not bypass the suction duct 234. Thus, the suction screen member not only acts as a screening function, but also a bridging function bridging the gap between the suction inlet fitting and the suction duct.

Recognizing that there can be tolerance issues and/or assembly inaccuracies that result in slight misalignments between the suction duct and the inlet fitting in their respective openings, different means are contemplated for accommodating misalignment. For example, in the present embodiment, the dome portion 360 provides a surface that helps to self locate during installation, as it can co-act with the tapered guide surface 340 on the suction duct 234 to guide insertion. Additionally, and considering that the tubular extension 344 is of a larger diameter than the dome portion 360 and/or liner segment 362 and is configured to be closely received into complete or almost complete circular engagement with the opening flange 338 of the suction duct 234, axial slots 364 are formed partially into the tubular extension and extend from the terminating end thereof partially toward the mounting flange 342 to thereby provide some flexibility in the tubular extension structure. Specifically, the slots 364 allow for contraction and expansion of the terminating end portion of the tubular extension 344 so that misalignments can be accommodated while the tubular extension 344 is still closely received and engages the opening flange 338 of the suction duct 234.

Figure 16:
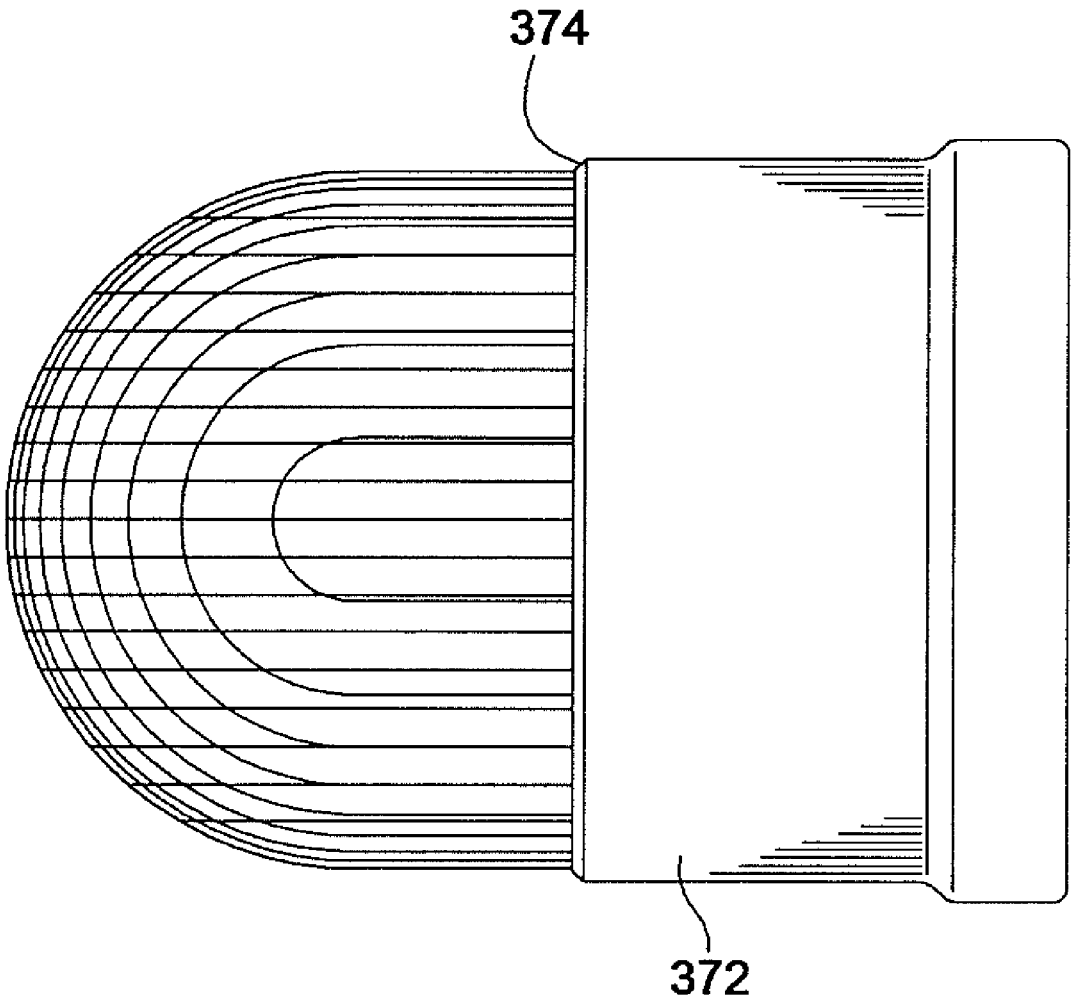
FIG. 16 is a side view of an alternative second embodiment of a suction screen member that may be substituted and/or interchanged in place of the screen of the first embodiment in the scroll compressor of FIGS. 1-4.

As shown in the alternative embodiment of FIG. 16, an alternative means for accommodating misalignment is provided in the form of a thin sheet metal body sleeve (on the order of about 0.015 inch and typically less than 0.02 inch) to provide a solid metal tubular extension 372 that can flex to accommodate misalignment without necessarily requiring the slots. To assist further and to facilitate such metal flexure, preferably a chamfer 374 is provided on the terminating end of the solid metal tubular extension 372 to facilitate better insertion and deflection of the tubular extension 372.

Figure 17:
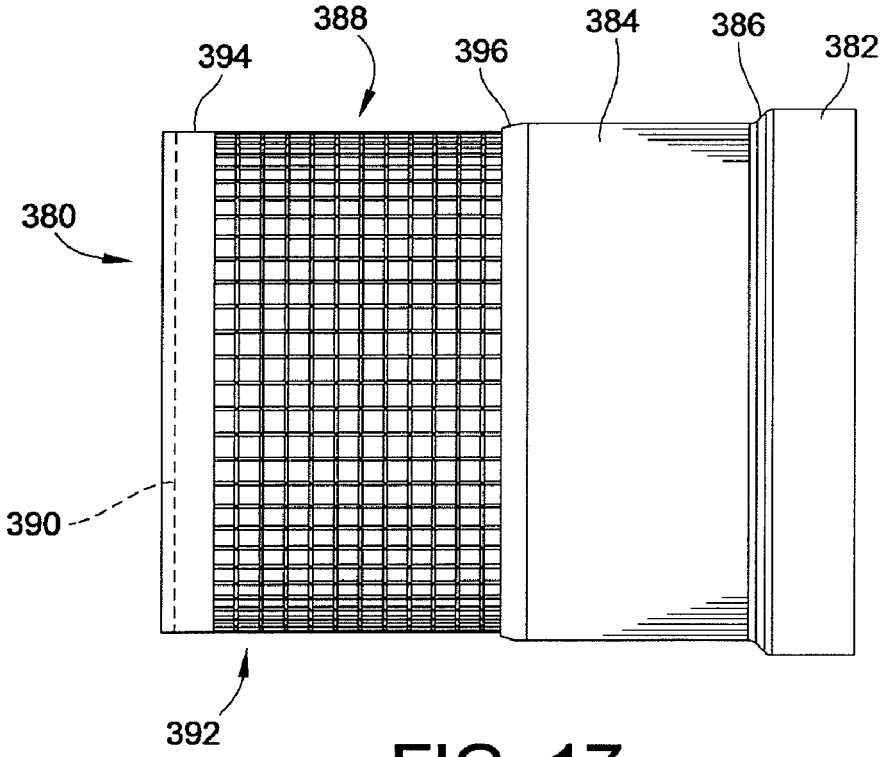
FIGS. 17, 18 and 19 are side, end and isometric views of an alternative third embodiment that may be substituted and/or interchanged in place of the screen of the first embodiment in the scroll compressor of FIGS. 1-4.
Figure 18:
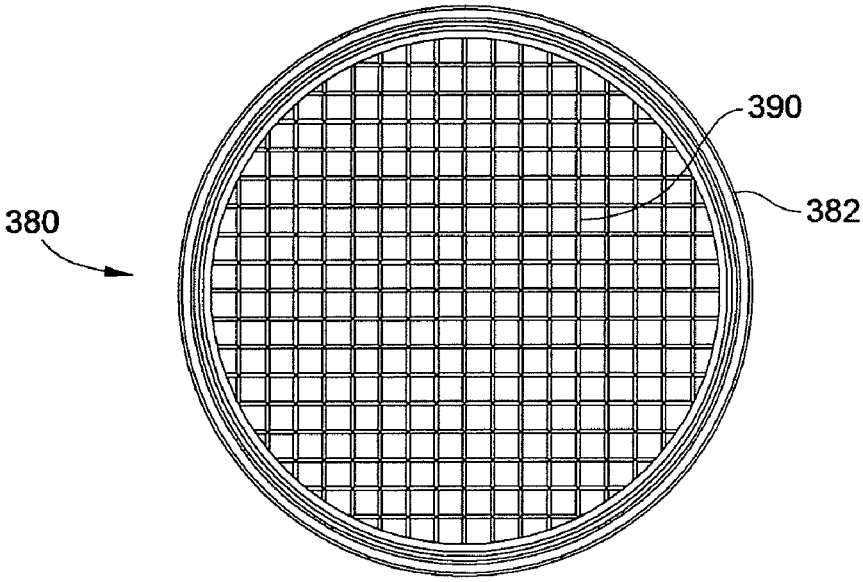
Figure 19:
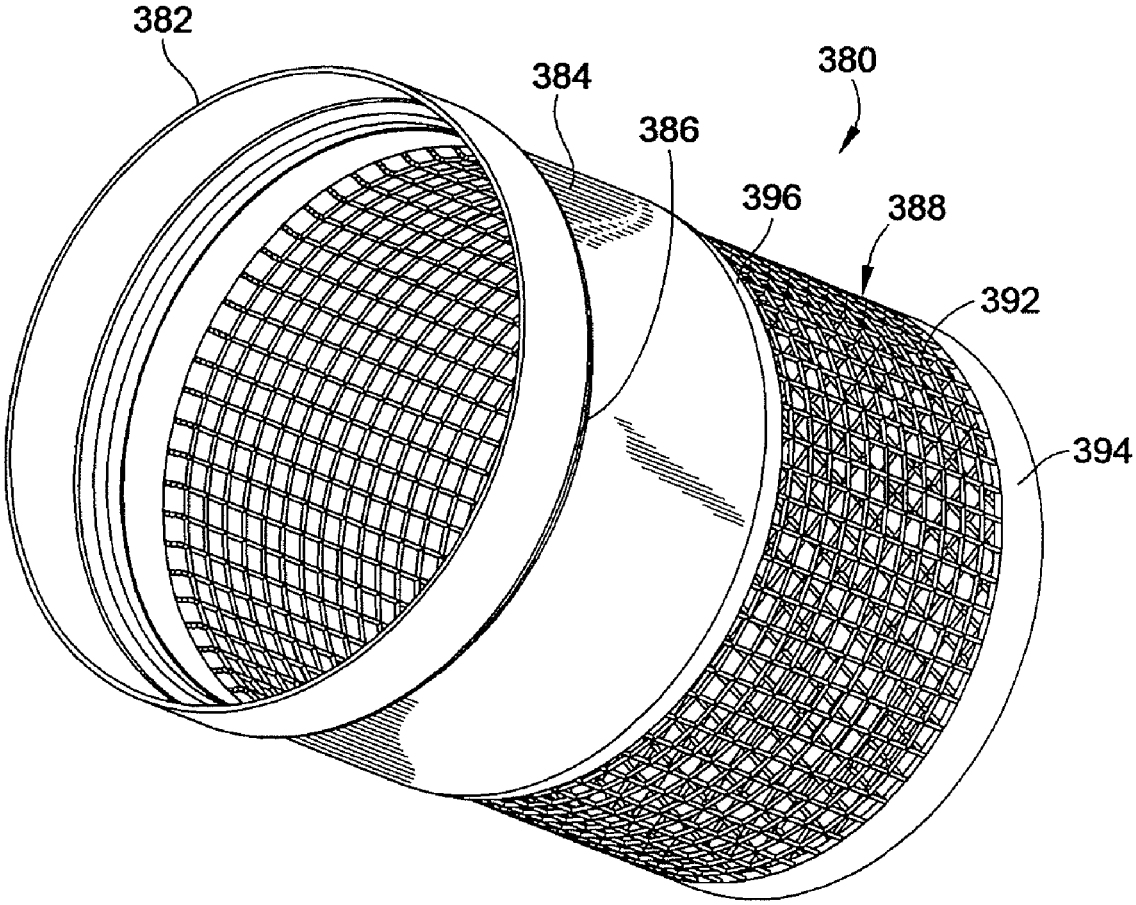

Another embodiment of a suction screen member 380 is illustrated in FIGS. 17-19. This embodiment also includes a ring body formed from metal such as sheet metal but in this embodiment is only a single layer thick along its length and without having a crimped section as in the first embodiment. The ring body includes an annular mounting flange 382 and a tubular extension 384 joined by an annular neck 386 that provides a seating surface similar to the first embodiment and thereby is installable in the same housing shown in FIGS. 1-4 against the same seat of the inlet fitting (see FIG. 11). In this embodiment a screen 388 of mesh material is also provided, but this embodiment includes a flat end disc 390 and a cylindrical liner 392. At the corner therebetween a protective border frame 394 is provided in surrounding relation. The border frame 394 is of smaller size and perimeter than the tubular extension so as to better facilitate assembly and installation. A chamfer 396 may also be provided on the terminating edge of the tubular extension to provide means for accommodating misalignment during assembly. The cylindrical liner 392 is bonded to the inside wall surface of the tubular extension 384 such as by welding (e.g. fusing the materials together).

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A scroll compressor, comprising:

a housing having an inlet opening and an outlet port, an inlet fitting mounted into the inlet opening providing an inlet port;

scroll compressor bodies in the housing, the scroll compressor bodies having respective bases and respective scroll ribs that project from the respective bases and which mutually engage, the scroll compressor bodies operative to compress fluid entering from the inlet port and discharge compressed fluid toward the outlet port;

a motor providing a rotational output operatively driving one of the scroll compressor bodies to facilitate relative movement for the compression of fluid;

a suction duct in the housing having an entrance port;

a suction screen member having a mounting flange mounting the suction screen member in the inlet fitting, a tubular extension bridging the inlet port and the entrance port, and a screen arranged to screen fluid flow flowing through the suction screen member; and wherein the motor is disposed within a motor housing, the motor housing being disposed within the housing, and wherein the suction duct is attached to an outside surface of the motor housing.

2. The scroll compressor of claim 1, wherein the inlet fitting defines a bore including sections of larger and smaller diameters joined at an annular seat, the mounting flange being seated on the annular seat, the tubular extension projecting through the section of smaller diameter.

3. The scroll compressor of claim 2, wherein the tubular extension is generally cylindrical and wherein the section of smaller diameter and the entrance port define openings of a substantially similar diameter, wherein the tubular extension has an outer diameter substantially corresponding to the substantially similar diameter to provide substantial circular engagement between the tubular extension and each of the entrance port and the inlet port thereby forming a substantially sealed bridge therebetween.

4. The scroll compressor of claim 2, wherein the mounting flange and the tubular extension are unitarily formed from sheet metal, wherein the mounting flange comprises a folded over metal section comprising inner and outer generally cylindrical rings joined at a bend forming an upstream end of the suction screen member, thereby making the mounting flange at least two layers thick of sheet metal, and wherein an annular neck connects the mounting flange and the tubular extension, the tubular section being generally cylindrical and of smaller diameter than the mounting flange, the tubular extension being a single layer thick of sheet metal.

5. The scroll compressor of claim 4, wherein said screen comprises a dome shaped screen structure projecting away from a terminating end of the tubular extension at a location inside of the suction duct.

6. The scroll compressor of claim 5, wherein the screen includes a generally cylindrical liner segment lining the tubular extension and being trapped within the fold over metal section.

7. The scroll compressor of claim 6, wherein axially extending slots are formed partially into the tubular extension allowing for contraction and expansion of a terminating end portion of the tubular extension.

8. The scroll compressor of claim 2, further comprising:

means for accommodating misalignment between the section of smaller diameter and the entrance port.

9. The scroll compressor claim 8, wherein said means comprises axially extending slots formed in the tubular extension.

10. The scroll compressor of claim 8, wherein said means for accommodating misalignment comprises a chamfer on a terminating end of the tubular extension.

11. The scroll compressor of claim 8, wherein the tubular extension is sufficiently thin to provide flexibility to accommodate misalignment.

12. The scroll compressor of claim 1, wherein said screen comprises a dome shaped screen structure projecting away from a terminating end of the tubular extension at a location inside of the suction duct.

13. The scroll compressor of claim 1, wherein the suction duct comprises a formed sheet metal body, the entrance port defined by an internally directed annular flange formed integrally into the formed sheet metal body, the annular flange tapering to a smaller diameter as the annular flange projects internally to provide a guide means for guiding the suction screen member into the suction duct.

14. The scroll compressor of claim 1, wherein the suction duct provides a fluid flow path to a drain port located at or near a bottom end of the motor housing.

15. A suction screen member comprising:

a ring body including a mounting flange and a tubular extension joined by an annular neck; and a screen;

the tubular extension being generally cylindrical and having a smaller perimeter than the mounting flange, the screen lining at least a portion of the tubular extension and being supported by the ring body, the screen arranged to screen fluid that flows through the tubular extension;

wherein the tubular extension is sufficiently long and sufficiently solid to provide a bridge that bridges and substantially seals between a scroll compressor housing inlet fitting and a scroll compressor suction duct to ensure that substantially all fluid flow flows from the scroll compressor housing inlet fitting to the scroll compressor suction duct.

16. The suction screen member of claim 15, wherein the ring body is unitarily formed from sheet metal, wherein the mounting flange comprises a folded over metal section comprising inner and outer generally cylindrical rings joined at a bend forming an upstream end of the suction screen member, thereby making the mounting flange at least two layers thick of sheet metal, and wherein the tubular extension being a single layer thick of sheet metal.

17. The suction screen member of claim 16, wherein said screen comprises a dome shaped screen structure projecting away from a terminating end of the tubular extension opposite the upstream end, wherein the screen includes a generally cylindrical liner segment lining the tubular extension and being crimped within the folded over metal section.

18. The suction screen member of claim 16, wherein axially extending slots are formed partially into the tubular extension allowing for contraction and expansion of a terminating end portion of the tubular extension.

19. The suction screen member of claim 16, wherein the tubular extension is sufficiently thin to provide flexibility for accommodating misalignment.

20. The suction screen member of claim 15, further comprising a chamfer on a terminating end of the tubular extension.

21. The suction screen member of claim 15, wherein the ring body is unitarily formed from metal of a single layer thick, and wherein the screen lines at least part of an inside surface of the ring body and is welded thereto.

22. The suction screen member of claim 21, wherein the screen includes an end disc portion and a cylindrical wall portion, and further comprising a border frame at an intersection of the end disc and the cylindrical wall portion, the border frame being sized smaller than the tubular extension.

23. A scroll compressor, comprising:

a housing having an inlet opening and an outlet port, an inlet fitting mounted into the inlet opening providing an inlet port;

scroll compressor bodies in the housing, the scroll compressor bodies having respective bases and respective scroll ribs that project from the respective bases and which mutually engage, the scroll compressor bodies operative to compress fluid entering from the inlet port and discharge compressed fluid toward the outlet port;

a motor providing a rotational output operatively driving one of the scroll compressor bodies to facilitate relative movement for the compression of fluid; and a suction duct in the housing having an entrance opening;

a suction screen member comprising:

a ring body including a mounting flange for mounting the suction screen member in the inlet fitting, and a tubular extension joined by an annular neck; and a screen;

the tubular extension being generally cylindrical and having a smaller perimeter than the mounting flange, the screen lining at least a portion of the tubular extension and being supported by the ring body, the screen arranged to screen fluid that flows through the tubular extension;

wherein the tubular extension is sufficiently long and sufficiently solid to provide a bridge that bridges and substantially seals between the inlet fitting and the suction duct to ensure that substantially all fluid flow flows from the inlet fitting to the suction duct.

* * * * *